United States Patent [19]

Weaver

[11] Patent Number: 4,789,572

[45] Date of Patent: Dec. 6, 1988

[54] ARTIFICIAL FLOWER

[76] Inventor: Ronald A. Weaver, 2024 Chestnut St., Emmaus, Pa. 18049

[21] Appl. No.: 42,039

[22] Filed: Apr. 24, 1987

[51] Int. Cl.[4] ..... A41G 1/00

[52] U.S. Cl. ..... 428/26; 156/61; 362/122

[58] Field of Search ..... 428/24, 25, 26; 156/61; 362/122, 805

[56] References Cited

U.S. PATENT DOCUMENTS

| | | | |
|---|---|---|---|
| 1,754,670 | 4/1930 | Crockett | 428/26 |
| 2,432,632 | 12/1947 | Seibel | 428/26 X |
| 2,892,074 | 6/1959 | O'Morrow | 428/24 X |
| 3,516,186 | 6/1970 | Arlet | 428/542.2 X |
| 3,610,917 | 10/1971 | Hunt | 428/24 X |
| 3,870,586 | 3/1975 | Backus | 428/24 |
| 4,600,612 | 7/1986 | Litwin et al. | 428/24 X |

*Primary Examiner*—Henry F. Epstein
*Attorney, Agent, or Firm*—Richard C. Litman

[57] ABSTRACT

An artificial flower display includes leaf, stem and flower elements formed from thermoplastic stock. Simulation of various flowers is achieved by surface grinding and coloring planar stock which is subsequently softened by heating to allow shaping into three-dimensional replicas of flower leaves and petals. Attachment formations on the petal and leaf sub-assemblies permit selective assembly of various sub-assemblies to any one stem element.

14 Claims, 2 Drawing Sheets

ARTIFICIAL FLOWER

BACKGROUND OF INVENTION

Field Of Invention

This invention relates generally to floral arrangements, and more particularly, to an improved artificial flower and method of making same.

It is known to construct synthetic flowers of artificial material such as paper, silk and other fabrics and wherein the selected material is painted, dyed or otherwise colored and shaped by any suitable means to represent the elements found in a floral arrangement. Many such arrangements require an inordinate amount of labor such as in the case of silk flowers wherein the fabric is stretched and adhesively attached to a shaped wire frame thereby requiring the use of disparate material.

By the present invention, an improved construction and method is presented wherein all of the components of a floral arrangement comprise a single composition of material namely, a thermoplastic synthetic resin, and wherein the steps leading to the manufacture of these flowers readily lend themselves to the mass production of not just one but practically a limitless number of combinations of flower arrangements.

SUMMARY OF THE INVENTION

Accordingly, one of the objects of the present invention is to provide an improved artificial flower display including petal and leaf sub-assemblies formed from surface-treated and colored sheet plastic composition and which are shaped into three-dimensional elements attached to an elongate stem element.

Another object of the present invention is to provide an improved artificial flower including thermoplastic petal and leaf elements provided with attachment formations permitting connection to an elongated stem element.

Still another object of the present invention is to provide an improved artificial flower including either single or dual leaf elements having integral base portions providing an attachment formation allowing replaceable connection to an elongate stem element.

A further object of the present invention is to provide an improved artificial flower including petal, stem and leaf components constructed of a synthetic resinous composition and mounted upon a base assembly containing a light source such that light rays are transmitted upwardly through the flower stem.

Another object of the present invention is to provide an improved method of making a floral arrangement comprising the steps of texturizing, coloring, heat-softening, shaping and assembling petal and leaf elements with stem elements.

With these and other objects in view which will more readily appear as the nature of the invention is better understood, the invention consists in the novel construction, combination and arrangment of parts hereinafter more fully described, illustrated and claimed with reference being made to the appended drawings wherein:

BRIEF DESCRIPTION OF THE DRAWINGS

Similar reference characters designate corresponding parts throughout the several figures of the drawings.

DESCRIPTION OF THE PREFERRED EMBODIMENTS

Figure 1:
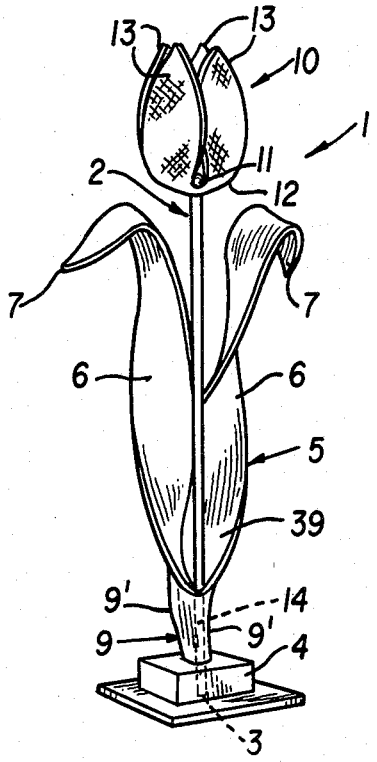
FIG. 1 is a front perspective view of an arrangement according to the present invention.

Referring now to the drawings, particularly FIG. 1, the present invention will be seen to comprise a floral arrangement, generally designated 1 and which will be understood to include a plurality of selectively assembled components all of which are preferably constructed of a thermoplastic synthetic resinous composition such as cast or extruded acrylic. The arrangement of this figure depicts a tulip and includes an elongate stem or rod 2 having a bottom 3 press fitted into an opening provided in a standard or support member 3. In this manner the relatively stationary stem 2 serves as a fixed mounting base for any one of a several different leaf and flower elements. In this embodiment the leaf element 5 will be seen to comprise twin main body portions 6-6 each having a tip 7 at their free ends and which are joined to a common central portion 8 in the area of the base 9.

Figure 1A:
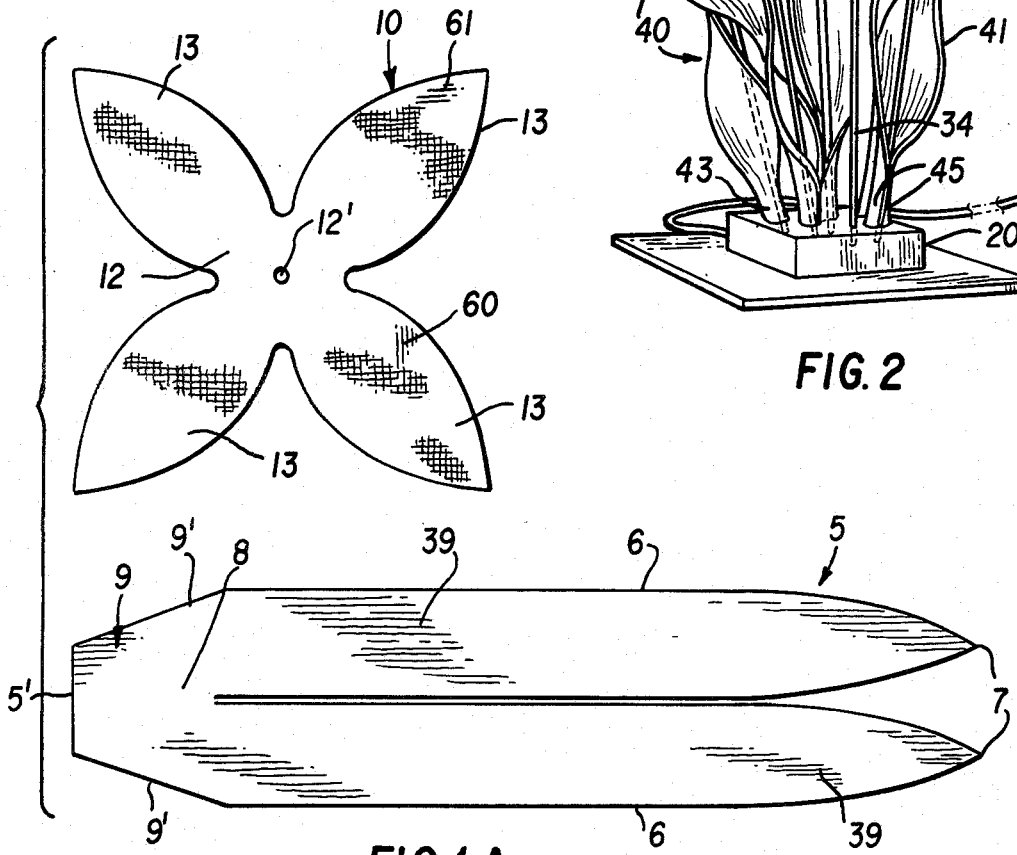
FIG. 1A is a top plan view illustrating two of the primary components employed in the production of the arrangement of FIG. 1.

The prepared blank of plastics material employed in the construction of the leaf 5 of FIG. 1 is shown most clearly in FIG. 1A. During the construction of the leaf 5, the blank is folded symmetrically about the central portion 8 as will be described in detail hereinafter, such that two opposed leaf base flaps 9'—9' are juxtaposed similar to that as shown more clearly in the embodiment of FIG. 2 of the drawings. The manner of providing a textured surface on the leaf elements, coloring same and then forming into the curved or curled arrangement as shown in the drawings will be described in the description of the method steps utilized in connection with this invention.

A suitable flower element 10 is adapted to be affixed adjacent the top portion 11 of the elongate stem 2. In the case of the tulip flower as shown in FIG. 1 of the drawings, the flower element 10 will be seen to include a base portion 12 which is provided with a central aperture 12' serving as an attachment formation. Radiating from this base 12 are a plurality of petals or lobes 13 adapted to be curved upwardly as shown in the drawings.

During the construction of the leaf of sub-assembly 5, an axially extending cavity 14 is formed between the leaf base central portion 8 and opposed flaps 9'—9' with the horizontal extent of this cavity 14 constructed to provide a close sliding fit about the periphery of the vertical stem 2 such that a selected leaf element 5 may be removably associated with a selected stem 2 of any flower arrangement. Similarly, any selected flower element 10 may be affixed adjacent the top 11 of a stem 2 such as by press fitting the flower element aperture 12' about the stem top 11.

Figure 2:
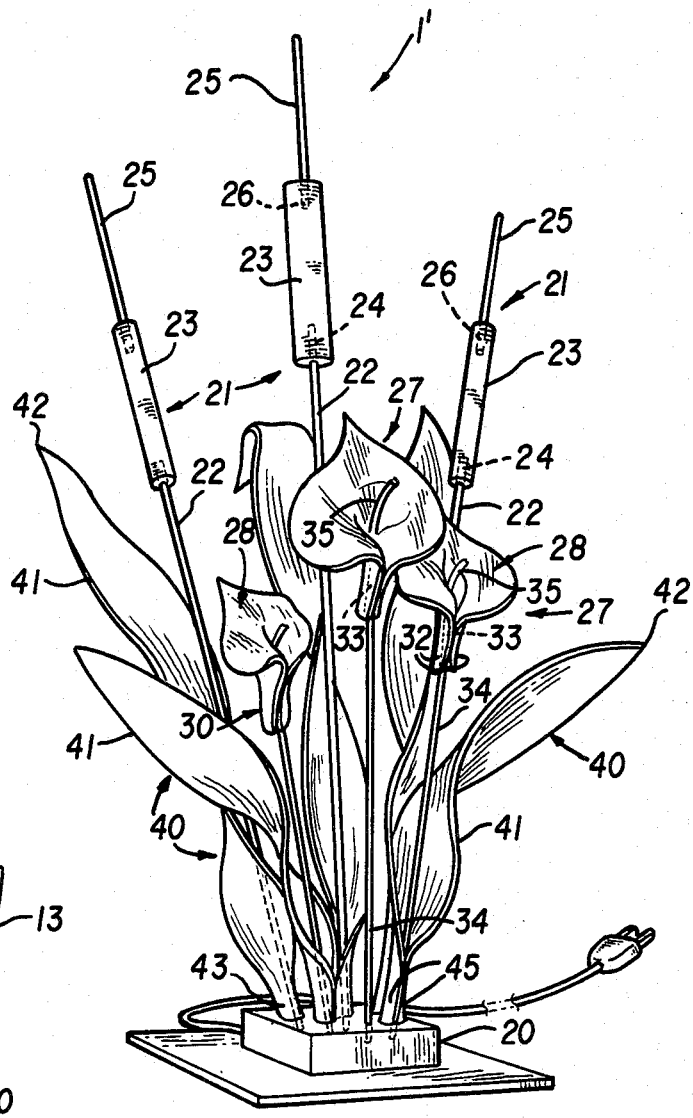
FIG. 2 is a front perspective view of another embodiment of the subject arrangement.

The flower arrangement 1' shown in FIG. 2 of the drawings depicts a plurality of two different flower assemblies mounted upon a single supporting member 20. Included are cattails generally designated 21, each comprising a main stem 22 mounted within the base 20 on the one end and attached to the lower portion of a flower element 23 at the other end. This flower element comprises a cylindrical plastic member having a diameter substantially greater than that of the rod 22 and is preferably attached to the rod such as by a bore 24 in its lower end. Projecting upwardly from each flower element 23 is a secondary rod 25 which is likewise attached to the flower element by means of a bore 26 in the upper portion thereof.

Figure 2A:
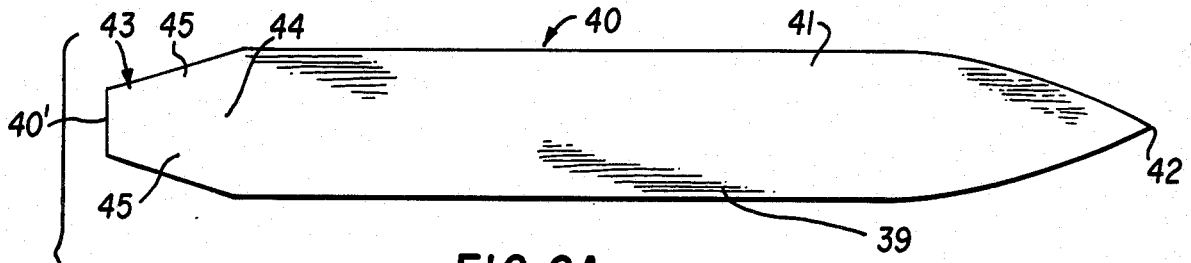
FIG. 2A is a top plan view of two of the components utilized in the formation of the arrangement shown in FIG. 2.

The flower 27 represents a lily such as a calla lily and comprises a flower element 28 constructed from a blank such as shown in FIG. 2A and which will be seen to include a tip 29 opposite a base 30 having a central portion 31 bounded by two flaps 32—32. The attachment of the flower 28 is accomplished by molding the blank, as will be described in detail hereinafter, so as to fold the flower base flaps 32—32 about the axis of the central portion 31, thereby forming an axially extending cavity 33 adapted to snugly receive the upper portion of the stem 34. The flower base 30 may be crimped or otherwise securely attached to the stem 34 at a location spaced beneath the stem top 35 such that the stem top will provide a simulated stamen, the latter of which may be angularly off-set or bent as shown in FIG. 2 of the drawings.

The leaf element 40 associated with both the cattails 21 and lily 27 is formed from a blank such as shown in FIG. 2A and comprises a single main body portion 41 having a tip 42 at one end and a base 43 at the other end. The base 43 includes a central portion 44 bounded by a pair of flaps 45—45 adapted to be folded about the intermediate central portion 44 to again provide an axially extending cavity 46 adapted to slidably surround either of the vertically extending stems 22, 34.

Figure 3:
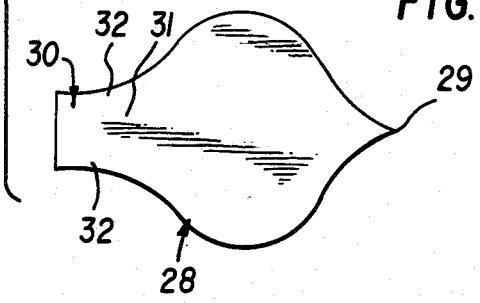
FIG. 3 is a top plan view of a petal element as utilized in the construction of a further embodiment of the present invention.
Figure 3:
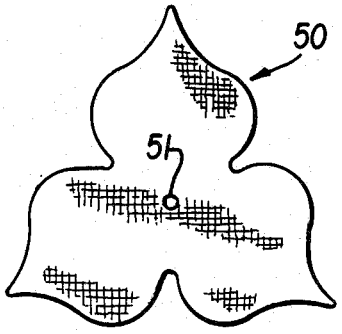

The flower blank illustrated in FIG. 3 illustrates a tri-lobe petal 50 such as may be constructed to simulate a daffodil flower and, as in the case of the tulip flower element 10, is provided with an attachment formation in the nature of a central aperture 51 for cooperation with the upper end of a stem.

Figure 4:
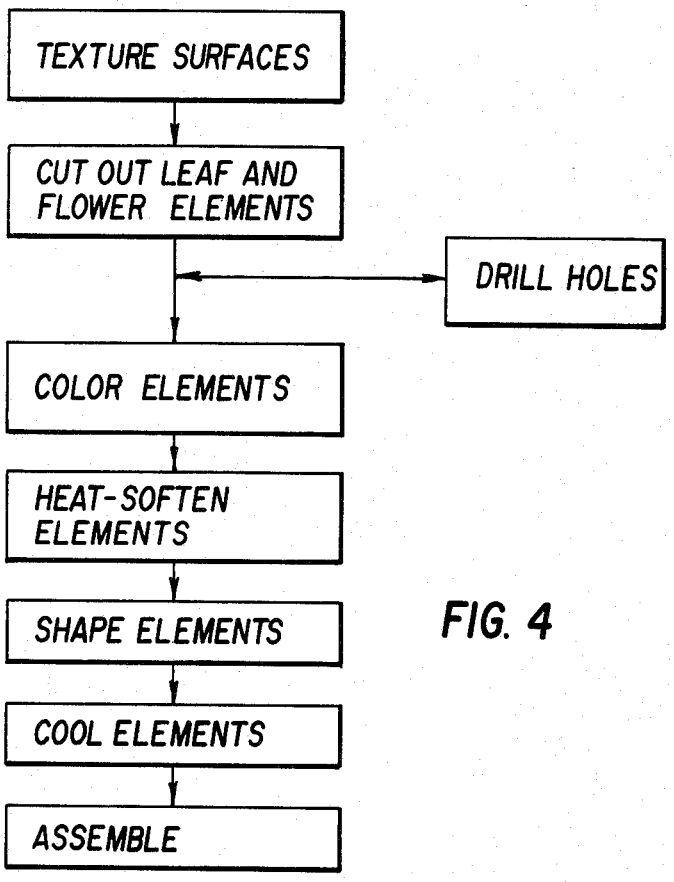
FIG. 4 is a flow diagram setting forth a sequence of steps employed in the manufacture of the present invention.

Additional structural features of the flower components will become apparent upon consideration of the steps involved in the unique method of making the flowers. FIG. 4 comprises a flow chart of the various steps involved in this method. Initially, sheets of plastic material such as cast acrylic, are textured on both faces in order to provide a grain to these surfaces. This is preferably accomplished by means of an endless belt sander which is passed across the surface of each side of each sheet. This sanding operation must be carefully controlled to provide the resultant desired grain appearance while care is exercised to preclude over heating of the stock material. Experience has shown that grit number 50 is the prefered sanding medium and readily provides the desired texture which may extend in but a single longitudinal direction along each sheet such as in the case of stock to be used for manufacture of the leaves, or alternatively, the sanding operation may be accomplished sequentially in two directions normal to one another to provide a first grain 60 and then a second grain 61 such as shown in the blank as illustrated in FIG. 1A of the drawings. Obviously, in the case of the leaf elements 5, 40, the usual desired effect is accomplished by producing a single longitudinal grain texture 39.

After the texture operation, the leaf and flower elements are cut out from respective sheets. This is preferably achieved by means of a cutter-equipped shaper as is generally well known in the cutting field.

If the particular elements being worked on comprise flower elements 10 or 50, the next step would comprise the formation of the apertures in the centers thereof and this is achieved by means of a drill.

The cut flower and leaf blanks are thereafter colored as desired. The coloring is accomplished by means of an acetone dye which is wiped on both surfaces of the blanks. The cut and colored blanks are now ready to be shaped into the desired three-dimensional configurations. In order to mold the components they must first be softened and this is achieved in a most reliable manner, by placing the elements upon a flat grill such as a gas fired plate. After softening, the individual elements are removed from the grill and hand shaped by workers using insulated gloves, to the configurations such as shown in FIGS. 1 and 2 of the drawings. In the case of the leaf elements, the shaping comprises twisting or curling the main body points and tips of the leaf elements and also pinching of the flaps at the base of each leaf to form the required axially extending cavity along the central portion of the leaf base in order to provide for the subsequent mounting to wholly embrace upon the elongated stem. This latter formation is done by wrapping the leaf base 9 or 43 about a stationary metal rod of the same diameter as the flower display stem.

In the case of the individual flowers, such as the tulip flower element, the individual petals or lobes 13 are bent upwardly from the flower base 12 and to the configuration such as shown in FIG. 1. In order to form the lily flower 27 as illustrated in FIG. 2, the base 30 of the blank in FIG. 2A is folded about the its central portion 31 until the flaps 32—32 about one another. Likewise, this latter formation is done about a steel rod having the same diameter as the subsequent stem with which the flower will be associated. Plier tools having padded jaws facilitate this latter operation as well as the pinching of the leaf bases.

Following shaping, the individual flower components are cooled by immersing in water. Thereafter, the flower elements and leaf elements are assembled with the desired stems. As previously described, the leaf elements are merely slipped over a mounted stem and lowered until their base bottom edge 5' or 40' abuts the standard 4 or 20. The flower elements are suitable affixed by means of either the aperture 12', 51 or the flower central portion 31. In either case, a heat gun or other suitable tool may be employed to more permanently secure the flower element adjacent the top of the stem. For the lily arrangement 27, the stem top 35 may extend upwardly beyond the stem/flower attachment and be heat softened and bent as shown in FIG. 2 to represent a stamen.

The assembly of the cattails 21 comprises attachment of a leaf element such an in the lilies 27 and also the attachment of a seed pod flower element 23 to the respective rod elements. This latter assembly step may be accomplished merely by a press fit of the respective ends of the rods into the bores 24, 26 previously formed at opposite ends of the pods. The flower elements or pods 23 may be constructed of the same material as the associated rods but will be seen to be of a substantially larger diameter. Before or after the individual lengths of the elements 23 are cut, the peripheral surface of each is horizontally textured, again by sanding. This may be done by placing the elements 23 in a drill while engaging the periphery thereof with appropriate sandpaper following which the elements are dyed in the same manner as the other elements.

In the case of any of the floral displays, an enhanced visual effect may be achieved by including suitable lighting element (not shown) within or beneath the base 4 or 20. In this manner light rays are transmitted upwardly through the respective stems.

What is claimed is:

1. A method of making an artificial flower element with stem and leaves from thermoplastic material and assembling said artificial flower element, said stem, and said leaves on a base member comprising:

selecting in elongated form said material for a stem, cutting a plurality of radial disposed petal elements and symmetrical leaf elements each having main body portions and flaps on a base from a planar sheet of said material providing an aperture centrally of said petal elements, heating said petal elements and said leaf elements until softened, forming said petal elements while still softened into a three-dimensional configuration having a base portion, forming said leaves from said leaf elements by twisting or curling the main body portions and by pinching said symmetrical leaf elements at said flaps to form axially extending cavities in said leaves, cooling said formed petal elements and said leaf elements, attaching said petal elements to said stem adjacent one end thereof, substantially embracing said stem with said leaves by slipping the leaf cavities about the stems and fixing the other end of said stem to said leaf base member.

2. The method according to claim 1 including forming a grained surface on said petal elements prior to said heating step.

3. The method according to claim 1 including coloring said petal elements before said attaching step.

4. The method according to claim 1 wherein said cooling comprises immersing said formed petals in water.

5. The method according to claim 2 wherein said grained surface is formed by a belt sander whereby, a grain texture is formed extending substantially in one direction prior to said heating step.

6. The method according to claim 2 wherein said grained surface is formed by a belt sander manipulated to form a grain texture extending along two angularly offset directions.

7. The method according to claim 3 wherein said coloring comprises wiping said petal elements with a dye.

8. The method according to claim 1 wherein said leaf element includes a single main body portion.

9. The method according to claim 1 wherein said leaf element includes a pair of main body portions joined to an integral base.

10. An artificial flower element with stem and leaves as produced according to the method of claim 1.

11. An artificial flower element with stem and leaves as produced according to the method of claim 2.

12. An artificial flower element with stem and leaves as produced according to the method of claim 3.

13. An artificial flower element with stem and leaves as produced according to the method of claim 5.

14. An artificial flower element with stem and leaves as produced according to the method of claim 6.

* * * * *